United States Patent [19]

Mestieri

[11] Patent Number: 4,698,968

[45] Date of Patent: Oct. 13, 1987

[54] PUMPING UNIT

[75] Inventor: Renzo Mestieri, King City, Canada

[73] Assignee: Black Gold Development Corporation, Concord, Canada

[21] Appl. No.: 805,858

[22] Filed: Dec. 6, 1985

[51] Int. Cl.[4] ..... F15B 15/18

[52] U.S. Cl. ..... 60/372; 60/328; 60/476

[58] Field of Search ..... 60/369, 370, 371, 372, 60/376, 377, 379, 380, 476, 328, 473

[56] References Cited

U.S. PATENT DOCUMENTS

| | | | |
|---|---|---|---|
| 1,708,584 | 4/1929 | Mason | 417/398 X |
| 2,612,142 | 9/1952 | Smith | 91/347 |
| 2,699,154 | 1/1955 | Smith | 91/311 |
| 3,005,413 | 10/1961 | Coberly | 60/372 |
| 3,782,117 | 1/1974 | James | 60/372 |
| 4,047,384 | 9/1977 | Saruwatari | 60/464 X |
| 4,347,049 | 8/1982 | Anderson | 60/372 |
| 4,392,792 | 7/1983 | Rogers | 417/400 |
| 4,414,808 | 11/1983 | Benson | 60/372 |
| 4,512,149 | 4/1985 | Weaver | 60/371 |

*Primary Examiner*—Edward K. Look

*Attorney, Agent, or Firm*—Bachman & LaPointe

[57] ABSTRACT

A pumping unit particularly for pumping oil from an oil bore has an inner stationary cylinder unit and an outer cylinder unit reciprocatable relative to the inner unit by hydraulic fluid; the units are enclosed in a casing and the outer unit functions as a piston in the casing; as the outer unit moves downwardly in the down-stroke, under the action of gravity and hydraulic fluid, air in the casing beneath it is displaced into a reservoir to form a supply of pressurized air; in the upstroke the supply of pressurized air is exploited to drive the outer cylinder upwardly, aided by the hydraulic fluid.

10 Claims, 6 Drawing Figures

PUMPING UNIT

BACKGROUND OF THE INVENTION (i) Field of the Invention

This invention relates to a pumping unit and a method of pumping; more especially the invention is concerned with an oil pumping unit and a method of pumping oil.

(ii) Description of the Prior Art

Pumping units for pumping oil and oil and water mixtures from underground sources are known, and function to vertically reciprocate a sucker rod in a bore or drill hole. In the down-stroke the unit is aided by gravity, in the up-stroke which is the working stroke, greater work is required to overcome gravity. Thus the power requirement is greater on the up-stroke than on the down-stroke.

One widely used pumping unit has a heavy cantilever weight which assists in the up-stroke, however, this means that the cantilever weight must be raised during the down-stroke, thereby necessitating the use of greater power in the down-stroke.

Existing pumping units have no means for readily varying different parameters such as the rate of pumping and the length of stroke.

SUMMARY OF THE INVENTION

It is an object of this invention to provide a pumping unit which can be operated with a lower power input than employed in conventional pumping units.

It is a further object of this invention to provide a pumping unit and method of pumping which generates during the down-stroke a power source for the up-stroke.

It is a further object of this invention to provide a pumping unit and method of pumping in which different parameters of the operation can be monitored and altered to provide a desired operation.

In accordance with one aspect of the invention there is provided a pump jack assembly including a first unit and a second unit mounted about the first unit. One of the units is stationary and the other is reciprocatable relative thereto. First and second discrete fluid hydraulic systems reciprocatably drive the reciprocatable unit relative to the stationary unit in first and second opposed directions. The systems are activatable alternately so that the reciprocatable unit is driven sequentially in the first and second directions. The reciprocating unit causes displacement of air during movement in the first direction, to generate a supply of pressurized air. During movement of the reciprocating unit in the second direction the pressurized air is delivered to pneumatically drive the reciprocating unit.

In this way the power requirement of the hydraulic system employed to drive the reciprocating unit in the second direction is markedly lowered.

DESCRIPTION OF PREFERRED EMBODIMENTS

In a particular embodiment the first unit is a stationary inner unit and the second unit is an outer unit reciprocatably mounted about it.

The inner unit particularly comprises an inner, vertically disposed, fixed cylindrical tube, an outer, fixed cylindrical tube disposed concentrically about the inner tube, and an intermediate, fixed cylindrical tube disposed concentrically between the inner and outer tubes, the tubes being mounted at their upper ends of a stationary mounting. The outer unit particularly comprises an inner vertically disposed cylindrical tube extending concentrically between the intermediate and outer fixed tubes; and an outer tube disposed concentrically about the fixed outer tube.

The fixed intermediate and outer tubes support bushings at their lower ends for guiding the outer unit in reciprocating movement relative to the inner unit.

Bushings, which function as pistons are mounted on the upper ends of the inner and outer tubes of the outer unit, to guide the outer unit in reciprocating movement relative to the inner unit.

The inner and outer units are mounted in a tubular housing. The bushing on the upper end of the outer tube of the outer unit functions as a piston and during vertical downward movement, the first direction, displaces air below it in the housing, into a reservoir to provide the source of pressurized air for the upward movement, the second direction.

DESCRIPTION OF PREFERRED EMBODIMENTS WITH REFERENCE TO THE DRAWINGS

Figure 1:
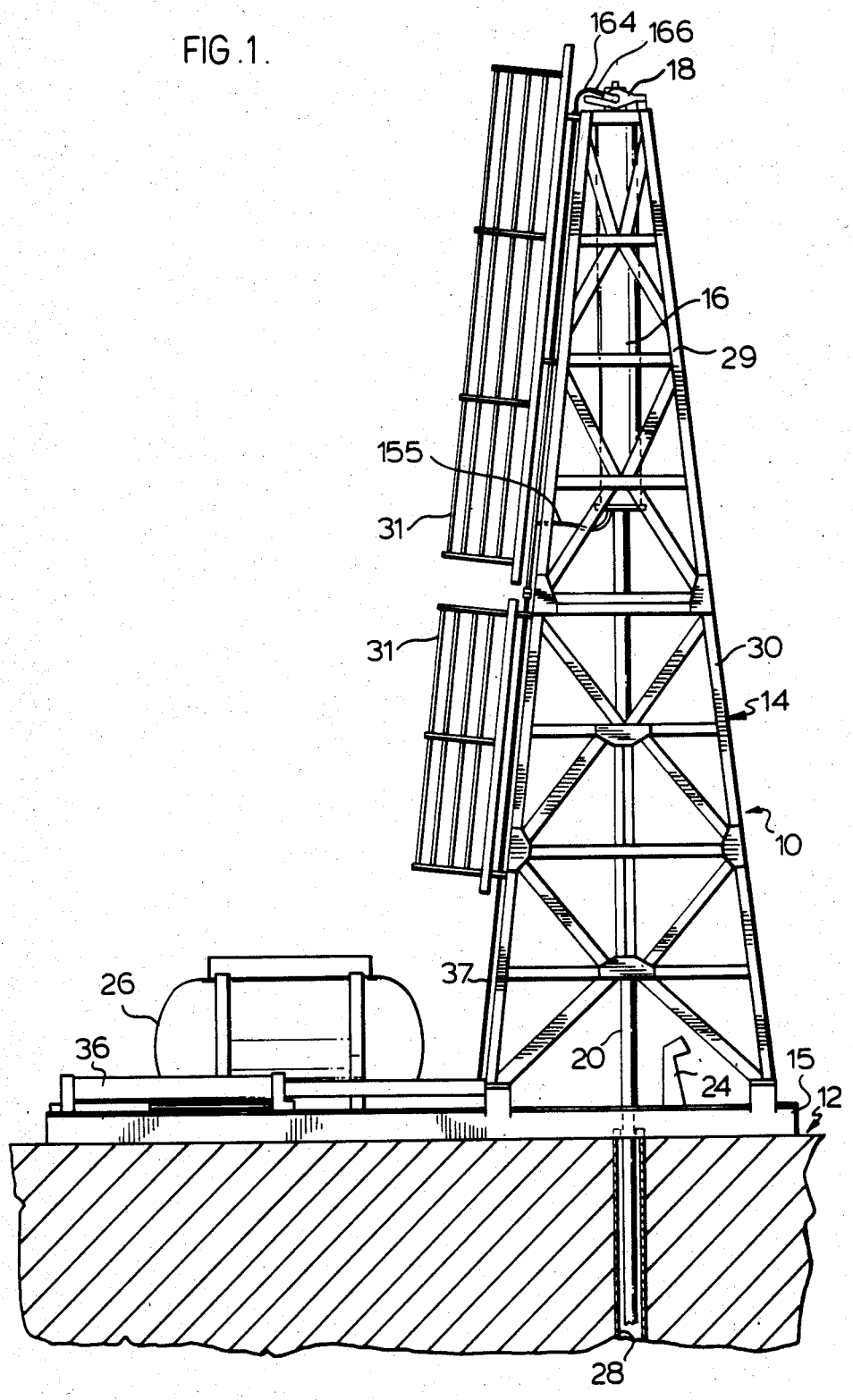
FIG. 1 is a front elevation of an oil pumping unit in accordance with the invention.
Figure 2:
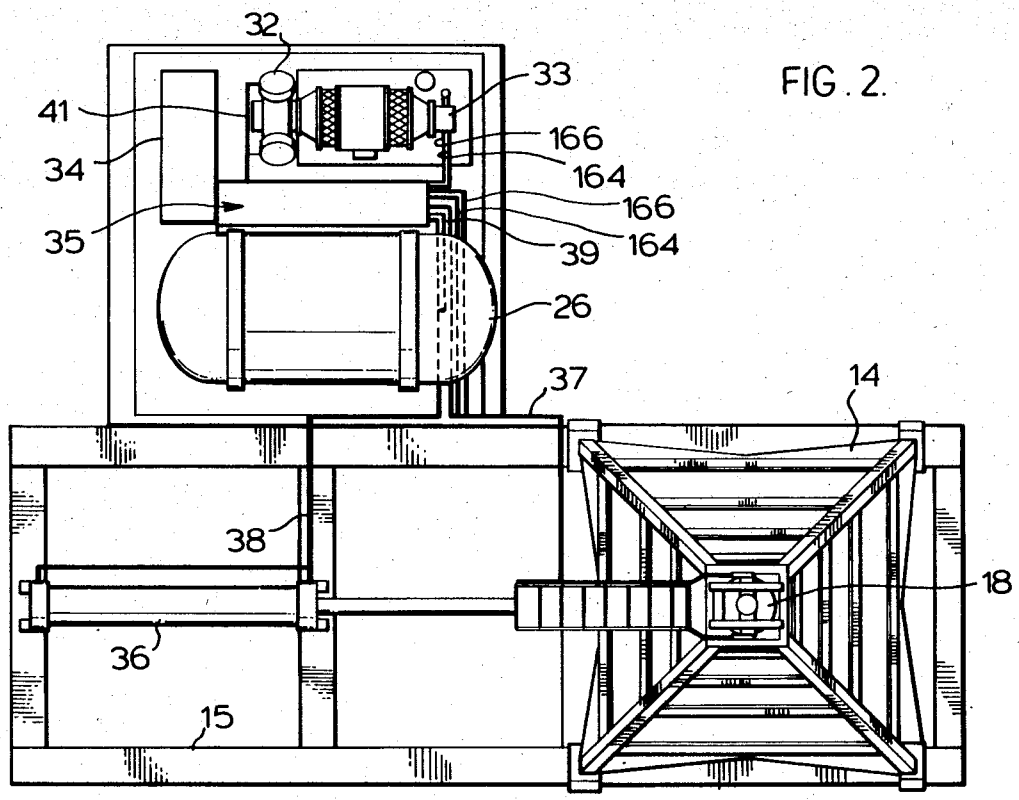
FIG. 2 is a schematic plan of the unit of FIG. 1.

With further reference to FIGS. 1 and 2, there is shown an oil pumping unit 10 supported on the ground 12.

Unit 10 includes a tower 14 mounted on base 15. A pump jack 16 is suspended from the top of tower 14 by a gimbal mounting 18. A sucker rod 20 is connected to pump jack 16.

A control unit 22, a data acquisition panel (production) 24, an air tank 26, and a tower cylinder 36 are supported on base 15.

Sucker rod 20 is disposed for reciprocation in a bore or drill hole 28 extending into the ground 12.

Tower 14 includes an upper section 29, a lower section 30 and access ladders 31.

Control unit 22 includes a pneumatic power unit 32, for example, an air compressor, a hydraulic power unit 33, for example, a hydraulic pump, a data acquisition panel (maintenance) 34 and power unit controls 35.

A main conduit 37 connects air tank 26 and control unit 22 with pump jack 16. Main conduit 37 includes fluid lines 164 and 166 which connect hydraulic power unit 33 with pump jack 16 through power unit controls 35, air lines 154 and 156. Air line 154 connects power unit controls 35 with pneumatic power unit 32 and air line 155 connects air tank 26 and pump jack 16.

A branched line 38 connects controls 35 with opposed ends of tower cylinder 36.

An air conduit 39 connects air tank 26 with power unit controls 35.

Figure 3:
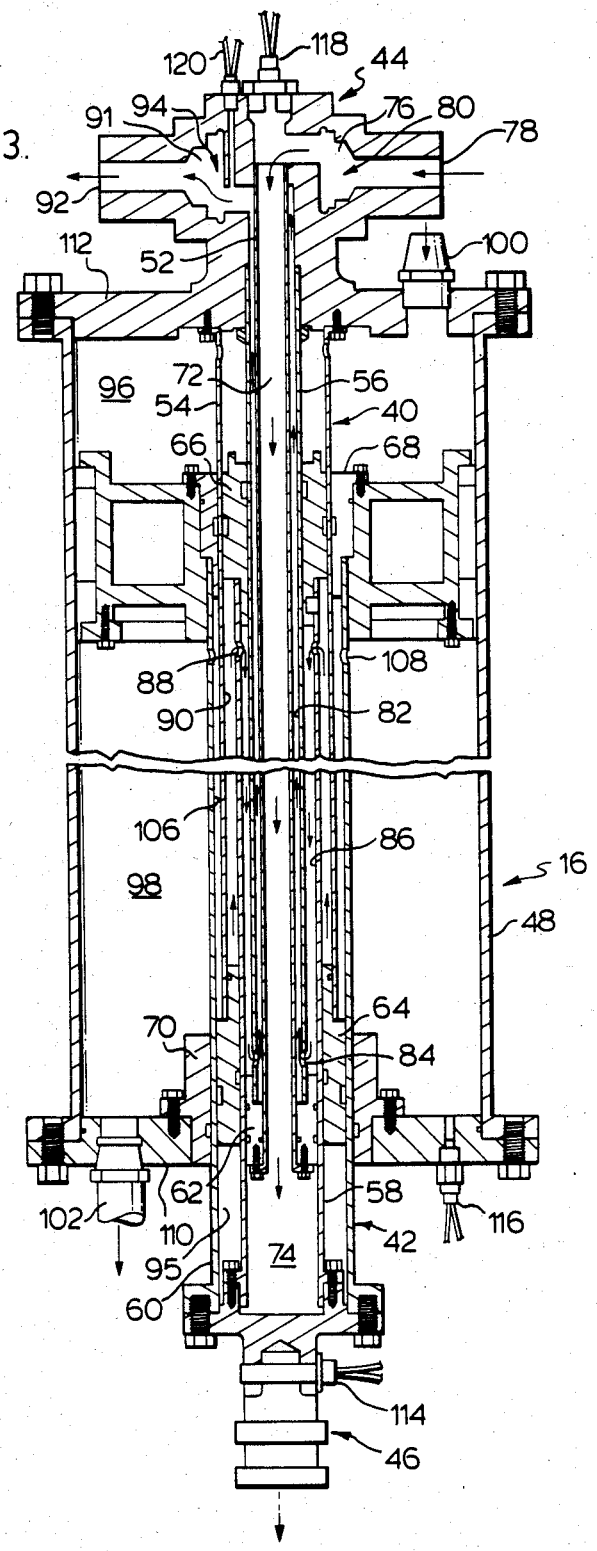
FIG. 3 shows a detail in cross-section, of the jack pump assembly of the pumping unit in a down-stroke position.
Figure 4:
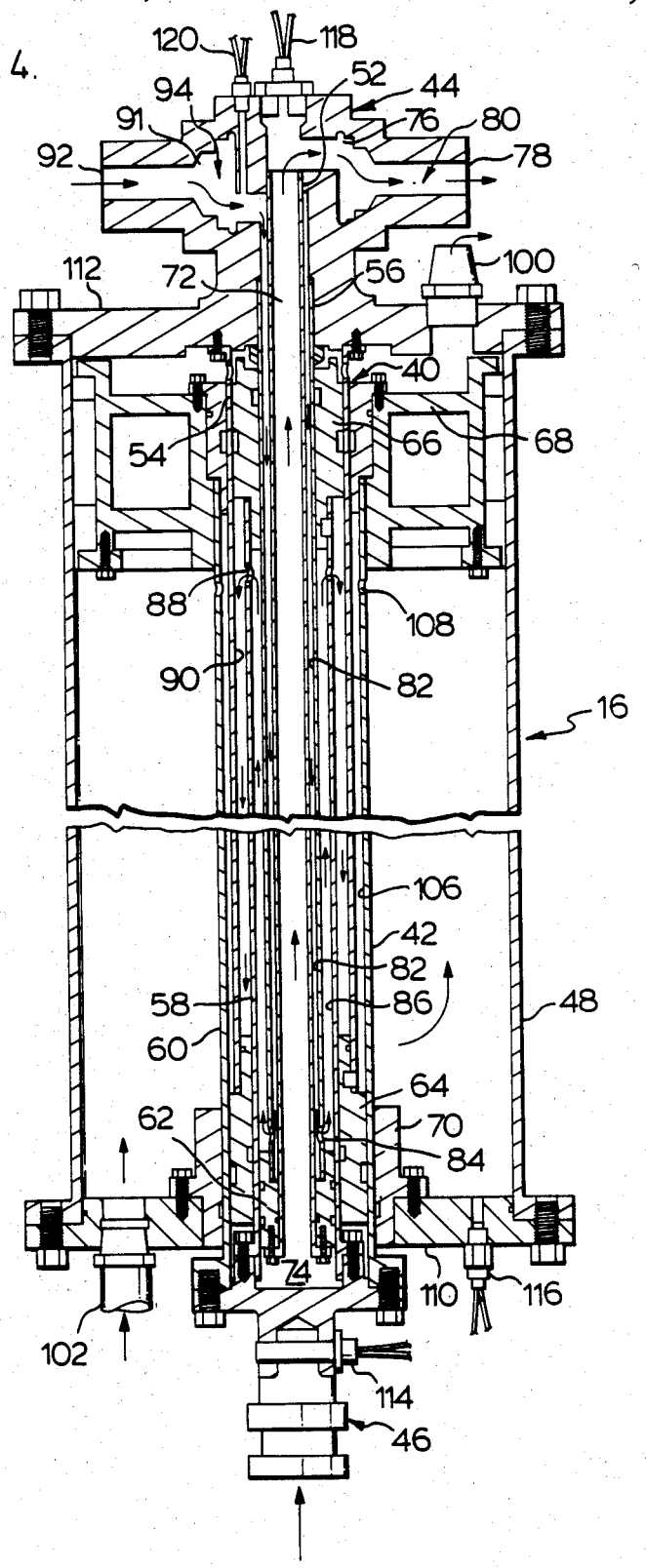
FIG. 4 shows a detail similar to FIG. 2 in an up-stroke position.

With further reference to FIGS. 3 and 4, pump jack 16 includes an inner cylinder unit 40 and an outer cylinder unit 42, a gimbal mount housing 44, a sucker rod connection 46 and a tubular housing 48.

Inner cylinder unit 40 includes a fixed inner cylinder 52, a fixed outer cylinder 54 and a fixed intermediate cylinder 56. Cylinders 52, 54 and 56 are concentrically arranged with intermediate cylinder 56 disposed between inner cylinder 52 and outer cylinder 54.

Outer cylinder unit 42 includes an inner cylinder 58 and an outer cylinder 60. Inner cylinder 58 is disposed concentrically between fixed intermediate cylinder 56 and fixed outer cylinder 54.

Outer cylinder 60 is disposed concentrically about fixed outer cylinder 54.

A stationary inner bushing 62 is mounted on a lower end of fixed inner cylinder 52, between fixed inner cylinder 52 of inner unit 40 and inner cylinder 58 of outer unit 42.

Stationary intermediate bushing 64 is mounted on a lower end of fixed outer cylinder 54 of inner unit 40 and extends between the inner and outer cylinders 58, 60 of outer unit 42.

A movable inner bushing 66 is mounted on an upper end of inner cylinder 58 of outer unit 42 and extends between cylinders 54 and 56 of inner unit 40.

A movable outer bushing 68 is mounted on an upper end of outer cylinder 60 of outer unit 42 and extends between fixed outer cylinder 54 of inner unit 40 and tubular housing 48.

Tubular housing 48 includes a lower base closure 110 and an upper head closure 112.

A stationary outer bushing 70 is mounted in base closure 110 and engages outer cylinder 60.

Fixed inner cylinder 52 has a central passage 72 and inner cylinder 58 has a central passage 74. Central passage 72 communicates at its upper end with a fluid channel 76 which communicates with a fluid port 78 connected to fluid line 164.

Central passages 72 and 74, fluid channel 76, and fluid port 78 together form a first fluid hydraulic system 80.

An annular passage 82 is defined between fixed inner cylinder 52 and fixed intermediate cylinder 56.

An annular passage 86 is defined between fixed intermediate cylinder 56 and inner cylinder 58. Fluid orifices 84 communicate with passages 82 and 86.

An annular passage 90 is defined between inner cylinder 58 and fixed outer cylinder 54. Fluid orifices 88 in inner cylinder 58 communicate with passages 86 and 90.

Annular passage 82 communicates with a fluid channel 91 which communicates with a fluid port 92 connected to fluid line 166.

Annular passages 82, 86 and 90, fluid channel 91 and fluid port 92 together form a second discrete fluid hydraulic system 94.

Annular passage 95 is defined between inner and outer cylinders 58, 60.

An upper chamber 96 is defined in housing 48 between head closure 112 and outer bushing 68. A lower air chamber 98 is defined in housing 48 between base closure 110 and movable outer bushing 68.

An air port 100 is disposed in head closure 112 and an air port 102 is disposed in base closure 110. Air port 102 is connected by air line 155 to air tank 26.

An annular passage 106 is defined between fixed outer cylinder 54 of inner unit 40 and outer cylinder 60 of outer unit 42. Air orifices 108 in outer cylinder 60 provide air flow communication between annular passage 106 and lower air chamber 98.

Position sensor 114 is connected to sucker rod connection 46. Air pressure sensor 116 is connected to lower air chamber 98. Fluid sensors 118 and 120 are connected to hydraulic systems 80 and 94, respectively.

Figure 5:
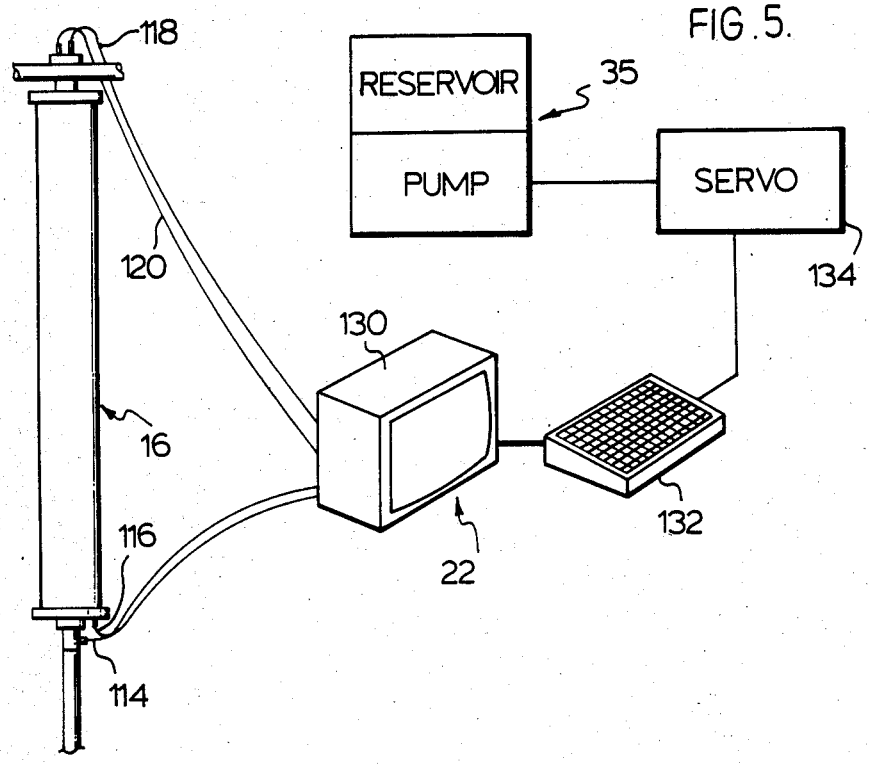
FIG. 5 illustrates schematically the pump jack and its control assembly.

With further reference to FIG. 5 pump jack 16 is schematically shown with sensors 114, 116, 118 and 120 connected to control unit 22 which includes a display monitor/data store 130 connected to an instruction panel or keyboard 132 which directs instructions in electronic form to a servo 134 which translates the instructions to a mechanical input to the power unit controls 35.

Figure 6:
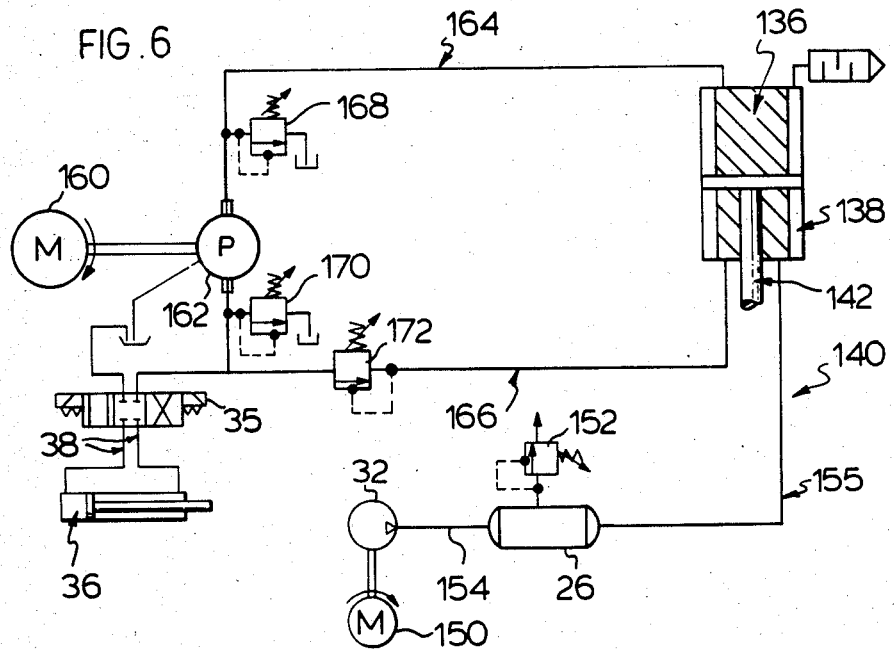
FIG. 6 illustrates a hydraulic and pneumatic circuit for the pumping unit of FIG. 1.

With further reference to FIG. 6 a hydraulic and pneumatic circuit 140 includes the hydraulic system generally designated 136, the pneumatic system designated 138, sucker rod 142 and tower cylinder 36.

The pneumatic system 138 includes a motor 150, air compressor 32 and air tank 26 with a valve 152, and air lines 154 and 155.

The hydraulic system 136 includes a motor 160, hydraulic pump 33, fluid lines 164 and 166 and valves 168, 170 and 172.

A generator (not shown) drives motors 150 and 160.

The pneumatic system also suitably includes an air lubricator unit.

Tower cylinder 36 is connected through lines 38 to controls 35.

The operation is more particularly illustrated by reference to FIGS. 3 and 4.

With particular reference to FIG. 3, the downstroke to drive the sucker rod 20 vertically downwardly in bore hole 28 is initiated by pumping hydraulic fluid, particularly oil under pressure through fluid port 78 into first hydraulic system 80. The hydraulic fluid passes along fluid channel 76 into central passage 72 and thence into central passage 74, in the direction shown by the arrows in FIG. 3, where it engages sucker rod connection 46 and forces it down under pressure, whereby outer cylinder unit 42 slides downwardly relative to fixed inner unit 40. Inner cylinder 58 is guided between stationary bushings 62 and 64 and outer cylinder 60 is guided between stationary bushings 64 and 70.

The downward movement of outer cylinder unit 42 is thus effected by gravity and the pressurized fluid introduced through port 78 into central passages 72 and 74, so that pressurized fluid acts vertically downwardly on sucker rod connection 46 at the lower end of passage 74.

The air port 100 is open to atmospheric air.

During the descent of outer cylinder unit 42, hydraulic fluid in the second fluid hydraulic system 94 is discharged along annular passage 82, fluid channel 91 and out through fluid port 92 to line 166, an annular passages 86 and 90 are collapsed or reduced in volume with the descent of bushing 66, which functions as a piston, towards stationary intermediate bushing 64.

The direction of flow of the discharging hydraulic fluid of system 94, upwardly along annular passage 90, through fluid orifices 88, downwardly in annular passage 86, through fluid orifices 84 and upwardly of annular passage 82 to the fluid channel 91 and fluid port 92 is shown by the arrows in FIG. 3.

During the descent of outer cylinder unit 42, air in lower air chamber 98 is discharged or displaced through air port 102 into air tank 26 where it is held under pressure. In effect a supply of pressurized air is generated in situ in air tank 26 by the descent of outer cylinder unit 42 and the displacement of air in chamber 98.

With further reference to FIG. 4 the up-stroke is illustrated. The valving is adjusted so that hydraulic fluid is now discharged from first hydraulic fluid system 80 through fluid port 78 into line 164 as shown by the arrows in FIG. 4. Hydraulic fluid under pressure is now introduced from line 166 through fluid port 92 into second fluid hydraulic system 94. The hydraulic fluid flows in system 94 in the direction shown by the arrows.

As annular passages 86 and 90 are filled with hydraulic fluid under pressure an upthrust is developed on bushing 66, which functions as a piston, to force outer cylinder unit 42 vertically upwardly. In this stage the valving is adjusted so that the pressurized air in air tank 26 is fed through air port 102 into lower air chamber 98, to pneumatically drive bushing 68, which functions as a piston, upwardly thus driving unit 42 upwardly.

In this way the upward thrust driving outer cylinder unit 42 and sucker rod 20 upwardly is provided both by hydraulic fluid pressure on bushing 66 and by pneumatic pressure on bushing 68. During the ascent of outer cylinder unit 42, air is exhausted from upper air chamber 96 through air port 100.

If necessary, additional air under pressure can be fed to air tank 26 from air compressor 32 to enhance the pneumatic drive on outer bushing 68.

By use of the air pressure generated in the down-stroke of the pump jack 16, to drive the outer cylinder unit upwardly in the up-stroke, which is the working stroke which extracts oil from the bore hole 28, a considerable saving is effected in that reduced hydraulic power is required in the up-stroke.

In particular the pump jack 16 can be readily operated with a hydraulic fluid to an air load ratio of about 30% to 70%, so that the air pressure generated in the down-stroke provides about 70% of the effort to drive the outer unit 42 upwardly in the up-stroke. In this way it is possible to use a motor for the hydraulic power of much lower power inthe important working stroke (the up-stroke) than would otherwise be the case. A high horse power is not necessary in the down-stroke because of the role played by gravity in the descent of the outer cylinder unit 42.

The unit 10 can be withdrawn from its location over drill hole 28 by tower cylinder 36 which is controlled by controls 35.

By means of the control unit 22 and sensors 114, 116, 118, 120, different parameters of the pumping unit 10 can be monitored and the unit 10 controlled electronically in response to the information received.

In particular sensor 118 monitors the fluid pressure in hydraulic system 80 and sensor 120 monitors the fluid pressure in hydraulic system 94; sensor 116 monitors the air pressure in lower air chamber 98 and thus in air tank 26 and sensor 114 monitors the position of sucker rod 20 in bore hole 28, from which information can be derived as to the number of strokes made and the length of the strokes.

FIG. 5 illustrates schematically the control and monitoring of the system.

The sensors 114, 116, 118 and 120 supply information to the display monitor/data store 130, in response to this information instructions are directed by panel 132 to servo 134 to change particular parameters in accordance with an established programme.

Based on the information provided by the sensors the following parameters can be controlled:

(a) the length of the stroke of the sucker rod 20 can be maintained or adjusted, (b) the pressure of the hydraulic fluid can be continuously monitored and altered to reflect different requirements of the unit 10, (c) the pressure of the air in lower air chamber 98 can be continuously monitored and altered to reflect the different requirements of unit 10, (d) the volume of hydraulic fluid can be altered to speed up or slow down the stroking of the unit 10.

If any malfunction, overload or deviation from a prescribed programme occurs within unit 10, the monitor 130 will detect this and the panel 132 will send a signal through servo 134 to make an appropriate adjustment at power unit controls 35.

A flow meter (not shown) measures the flow of liquid pumped from hole 28 and based on the flow meter electronic information can be directed to data acquisition panel (production) 24, which will compute and display on request particulars as to the oil water mix extracted from hole 28, data as to the total barrels of oil and water pumped, the total barrels of oil pumped and the total barrels of oil per day.

Based on the information from sensors 114 and 116, compressed air may be delivered to air tank 26 from compressor 32 to supplement the generated pressurized air for the up-stroke, by activating the air compressor 32.

By means of the invention there is thus provided a unit characterized by simplicity of operation and control, having a minimal number of moving parts and which exploits a self generating power supply and gravity.

The unit is highly mobile, easy to dismantle and ship and erect.

The unit can be controlled locally or from a remote location and uses less power than other comparable units pumping the same amount of oil from the same depth of drill hole.

The unit can provide a larger and slower stroke which results in fewer reversals and less wear on the equipment.

The control unit provides overload protection thereby reducing problems and damage to equipment.

I claim:

1. A pump jack assembly comprising:

an elongated first tubular unit and an elongated second tubular unit mounted about said first unit, said first and second elongated tubular units having upper and lower ends, said first elongated tubular unit being stationary and said second elongated tubular unit being reciprocatable relative to said first unit, first and second discrete fluid hydraulic systems for reciprocatably driving said reciprocatable second unit in first and second opposed directions respectively, said first discrete hydraulic system being defined between said first and second units for fluid driving communication with said lower end of said second unit, and said second discrete hydraulic system being defined between said first and second units for fluid driving communication with said upper end of said second unit, said first and second discrete systems being activatable alternately to drive said reciprocatable second unit, said first and second units being supported in a tubular housing, an air piston mounted for movement with said reciprocatable second unit in said tubular housing, said air piston defining an upper air chamber and a lower air chamber in said tubular housing, said upper and lower air chambers circumscribing said first and second units, an air reservoir adapted to maintain a supply of air under pressure for delivery to said lower air chamber to pneumatically drive said reciprocatable second unit in said second direction, and to receive air under pressure displaced from said lower air chamber by movement of said air piston in said first direction, a position sensor operably connected to continuously monitor the position of said second unit, an air pressure sensor connected to said lower air chamber for continuously sensing air pressure in said lower air chamber, a first fluid sensor connected to said first system and a second fluid sensor connected to said second system for continuously sensing fluid pressure in said first and second systems, said position sensor, air pressure sensor and first and second fluid sensors being adapted to deliver sensed information in electronic form, for continuous monitoring of said unit in operation.

2. A pump jack assembly comprising:

an elongated first tubular unit and an elongated second tubular unit disposed around said first unit, said units having upper and lower ends, said first unit being stationary and said second unit being reciprocatably movable relative to said first unit, a stationary bearing means mounted on the lower end of said first unit between said first and second units, movable bearing means mounted on the upper end of said second unit for movement with said second unit between said first and second units, mounting means on said lower end of said second unit adapted to mount a sucker rod assembly on said second unit for reciprocatable movement therewith, mounting means on said upper end of said first unit for suspendingly mounting the jack assembly in vertical dispostion above ground, a tubular housing surrounding said first and second units between said upper and lower ends of said first unit, piston means mounted on said second unit between said second unit and said tubular housing for reciprocatable movement with said second unit within said tubular housing, said piston means defining an upper air chamber and a lower air chamber in said tubular housing, said upper and lower chambers circumscribing said first and second units, a lower air port in a lower end of said lower air chamber for air flow communication of said lower air chamber with an air reservoir adapted to maintain a supply of air under pressure and to receive air under pressure from said lower chamber, an upper air port in an upper end of said upper air chamber, a first discrete hydraulic system defined between said first and second units for fluid driving communication with said lower end of said second unit, a second discrete hydraulic system defined between said first and second units comprising fluid passages extending between said stationary bearing means and said movable bearing means, for fluid driving communication with said movable and stationary bearing means.

3. A pumping unit comprising a pump jack assembly as defined in claim 2, a tower and a gimbal mounting on said tower, said mounting means on said pump jack being mounted on said gimbal mounting, a fluid pump operably connected to said first and second hydrulic systems, and an air compressor connected to said air reservoir.

4. A pumping unit according to claim 3, further including a position sensor connected to said mounting means for continuously sensing the position of a sucker rod mounted in said mounting means, an air pressure sensor connected to said lower air chamber for continuously sensing air pressure in said lower air chamber, a first fluid sensor connected to said first system and a second fluid sensor connected to said second system for continuously sensing fluid pressure in said first and second systems, said position sensor, air pressure sensor and first and second fluid sensors being adapted to deliver sensed information in electronic form, signal receiving means connected to said sensors for receiving said sensed information, a power unit for operating said first and second hydraulic systems and said air reservoir, and instruction panel means connected between said signal receiving means and said power unit.

5. A pumping unit according to claim 4, wherein said signal receiving means comprises a display monitor and data store for sensed information, and means to translate electronic instructions from said instruction panel means to a mechanical input to said power unit.

6. A method of pumping oil from a drill hole comprising:

providing an elongated first tubular unit and an elongated second tubular unit disposed around said first unit, said units having upper and lower ends, said first unit being stationarily mounted and said second unit being reciprocatably movable relative to said first unit, said second unit being mounted for reciprocation within a tubular housing, an air piston mounted annularly of said second unit for reciprocation in said tubular housing, said second unit supporting a sucker rod assembly, driving said reciprocatable second unit supporting said sucker rod assembly, vertically downwardly in a drill hole in a down-stroke, under gravity and hydraulic fluid pressure in a first discrete fluid system acting on said lower end of said second unit, displacing air in said tubular housing with said air piston during said down-stroke, into a reservoir containing a supply of pressurized air to increase the supply of pressurized air, on completion of said down-stroke, pneumatically driving said air piston with said reciprocatable unit vertically upwardly with the increased supply of pressurized air and under hydraulic fluid pressure in a second discrete fluid system acting on said upper end of said second unit in an upstroke.

7. A method according to claim 6, wherein said down-stroke and up-stroke are repeated sequentially a plurality of times.

8. A pump jack assembly comprising:

an elongated first tubular unit and an elongated second tubular unit disposed around said first unit, said units having upper and lower ends, said first unit being stationary and said second unit being reciprocatably movable relative to said first unit, a stationary bearing means mounted on the lower end of said first unit between said first and second units, bearing means mounted on the upper end of said second unit for movement with said second unit between said first and second units, mounting means on said lower end of said second unit adapted to mount a sucker rod assembly on said second unit for reciprocatable movement therewith, a tubular housing surrounding said first and second units between said upper and lower ends of said first unit, piston means mounted on said second unit between said second unit and said tubular housing for reciprocatable movement with said second unit within said tubular housing, said piston means defining an upper air chamber and a lower air chamber in said tubular housing, said upper and lower air chambers circumscribing said first and second units, a lower air port in a lower end of said lower air flor communication of said lower air chamber with an air reservoir adapted to maintain a supply of air under pressure and to receive air under pressure from said lower air chamber, a first discrete hydraulic system defined between said first and second units having first fluid passage extending centrally of said first unit for fluid driving communication with said lower end of said second unit, said first system adapted to drive said second unit vertically downwardly relative to said first unit by downward fluid pressure in said first passage on said lower end of said second unit, a second discrete hydraulic system defined between said first and second units comprising second and third fluid passages extending between said stationary bearing means and said movable bearing means, for fluid driving communication with said movable and stationary bearing means, said second and third fluid passages circumscribing said first passage, fluid in said second system and pressurized air in said air reservoir being adapted to drive said second unit vertically upwardly relative to said first unit by fluid pressure in said second unit on said movable bearing means and by pressure of air from said air reservoir on said piston means.

9. A pump jack assembly according to claim 8, further including a plurality of sensors adapted to continuously sense different parameters of the assembly in operation and deliver information in electronic signal form, means to monitor and store the electronic information, and means for generating an output signal responsive to the electronic information.

10. A pump jack assembly comprising:

a tubular housing having a stationary upper mounting and a stationary lower mounting in opposed facing relationship, an elongated first stationary tubular unit disposed in said tubular housing, said first unit comprising an inner fixed cylindrical tube, an outer fixed cylindrical tube disposed concentrically about said inner tube, and an intermediate, fixed cylindrical tube disposed concentrically between said inner and outer fixed tubes, said inner, outer and intermediate fixed tubes being mounted at their upper ends on said stationary upper mounting, inner, intermediate and outer stationary annular bearing means adjacent said lower stationary mounting, said intermediate bearing means circumscribing and being spaced outwardly of said inner bearing means, said outer bearing means being mounted on said lower stationary mounting and circumscribing and being spaced outwardly of said intermediate bearing means, said inner and intermediate fixed tubes being connected at their lower ends to said inner bearing means said outer fixed tube being connected at its lower end to said intermediate bearing means, an elongated second movable tubular unit disposed in said tubular housing for reciprocating movement relative to said stationary unit, said second unit comprising an inner movable cylindrical tube and an outer movable cylindrical tube disposed concentrically about said inner movable tube, said inner movable tube extending concentrically about said intermediate fixed tube for reciprocating movement between said inner and intermediate stationary bearing means, said outer movable tube extending concentrically about said outer fixed tube for reciprocating movement between said intermediate and outer stationary bearing means, inner and outer annular piston means, said inner piston means being mounted on an upper end of said inner movable tube for reciprocation between said intermediate and outer fixed tubes, said outer piston means being mounted on an upper end of said outer movable piston means for reciprocation about said outer fixed tube, an annular air piston mounted for reciprocating movement with said second unit within said tubular housing, an annular upper air chamber defined in said housing between said upper mounting and said air piston, and an annular lower air chamber defined in said housing between said lower mounting and said air piston, said upper air chamber circumscribing said first unit, said lower air chamber circumscribing said second unit, an air tank maintaining a permanent supply of pressurized air in air flow communication with said lower chamber, a first fluid passage defined in said inner movable tube, said first and second fluid passages being in fluid flow communication adjacent said lower end of said inner fixed tube, and a first fluid channel in fluid flow communication with said upper end of said inner fixed tube, together forming a first discrete, hydraulic fluid flow system, an annular third fluid flow passage defined between said inner and intermediate fixed tubes, an annular fourth fluid flow passage defined between said inner movable tube and said intermediate fixed tube, and an annular fifth fluid flow passage defined between said fixed tube and said inner movable tube, said fourth passage extending between said inner bearing means and said inner piston means, said fifth passage extending between said intermediate bearing means and said outer piston means, a first fluid orifice means in said intermediate fixed tube adjacent said inner bearing means for fluid flow communication between said third and fourth passages, a second fluid orifice means in said inner movable tube adjacent said inner piston means for fluid flow communication between said fourth and fifth passages, a second fluid channel in fluid flow communication with said third fluid passage, to form with said third, fourth and fifth passages, a second discrete, hydraulic fluid flow system, an annular air flow passage defined between said outer movable and fixed tubes, extending between said intermediate bearing means and said outer piston means, air orifice means in said outer movable tube adjacent said air piston for air flow communication between said air passage and said lower air chamber, a mounting means on a lower end of said second unit adapted to mount a sucker rod assembly on said second unit for reciprocatable movement therewith, a position sensor connected to said mounting means for continuously sensing the position of a sucker rod mounted in said mounting means, an air pressure sensor connected to said lower air chamber for continuously sensing air pressure in said lower air chamber, a first fluid sensor connected to said first system and a second fluid sensor connected to said second system for continuously sensing fluid pressure in said first and second systems, said position sensor, air pressure sensor and first and second fluid sensors being adapted to deliver sensed information in electronic form, and, means to receive said sensed information in electronic form.

* * * * *